US009139354B2

(12) United States Patent
Holford

(10) Patent No.: US 9,139,354 B2
(45) Date of Patent: Sep. 22, 2015

(54) PACKAGE FOR SMOKING ARTICLES

(75) Inventor: Steven Holford, London (GB)

(73) Assignee: British American Tobacco (Investments) Limited, London (GB)

( * ) Notice: Subject to any disclaimer, the term of this patent is extended or adjusted under 35 U.S.C. 154(b) by 294 days.

(21) Appl. No.: 12/937,824

(22) PCT Filed: Mar. 18, 2009

(86) PCT No.: PCT/EP2009/053189

§ 371 (c)(1), (2), (4) Date: Feb. 9, 2011

(87) PCT Pub. No.: WO2009/127487

PCT Pub. Date: Oct. 22, 2009

(65) Prior Publication Data

US 2011/0155596 A1 Jun. 30, 2011

(30) Foreign Application Priority Data

Apr. 14, 2008 (GB) ..... 0806700.1

(51) Int. Cl.
*B65D 85/10* (2006.01)
*B65D 5/66* (2006.01)

(52) U.S. Cl.
CPC ..... *B65D 85/1045* (2013.01); *B65D 5/6691* (2013.01)

(58) Field of Classification Search
CPC ..... B65D 85/1045; B65D 85/1081; B65D 5/543; B65D 85/12; B65D 85/1027; B65D 75/38
USPC ..... 206/266, 274, 273, 271, 268, 265, 264, 206/259, 245, 242, 261, 270; 229/87.13, 229/114, 146, 160.1, 148, 931, 920, 125.28, 229/125.29, 150, 149, 225, 87.2, 87.14
See application file for complete search history.

(56) References Cited

U.S. PATENT DOCUMENTS

| | | | | |
|---|---|---|---|---|
| 2,848,152 | A * | 8/1958 | Geiger, Sr. | 229/160.1 |
| 2,922,565 | A * | 1/1960 | Roderick et al. | 229/145 |
| 3,708,108 | A * | 1/1973 | Rosenburg, Jr. | 229/225 |
| 3,963,173 | A * | 6/1976 | Stone | 229/225 |

(Continued)

FOREIGN PATENT DOCUMENTS

| | | | |
|---|---|---|---|
| CA | 654558 | A | 12/1962 |
| CN | 86102941 | A | 11/1986 |

(Continued)

OTHER PUBLICATIONS

International Search and Written Opinion corresponding to PCT/EP2009/053189 mailed May 19, 2009.

(Continued)

*Primary Examiner* — Jacob K Ackun
*Assistant Examiner* — Jenine Pagan
(74) *Attorney, Agent, or Firm* — N W Poulsen; D Tilahun

(57) ABSTRACT

A package for smoking articles comprising a body (3) and a lid (17) hingedly connected to the body to enclose a space defined by the body when the lid is closed, the lid including an end portion and a wall extending from the end portion that overlaps a face of the body when closed, wherein a recess (68) is formed in the wall and a tab (60, 61) extends from said face, such that, when the lid is closed, the tab locates in said recess.

21 Claims, 14 Drawing Sheets

(56) References Cited

U.S. PATENT DOCUMENTS

| | | | | |
|---|---|---|---|---|
| 4,216,898 | A | 8/1980 | Davies | |
| 4,753,384 | A * | 6/1988 | Focke et al. | 229/160.1 |
| 5,129,513 | A * | 7/1992 | David et al. | 206/265 |
| 5,143,282 | A * | 9/1992 | Pham | 229/160.1 |
| 5,341,925 | A * | 8/1994 | Fleenor et al. | 206/268 |
| 5,366,077 | A * | 11/1994 | Pham | 206/268 |
| 5,388,758 | A * | 2/1995 | Scovell | 229/146 |
| 5,806,671 | A * | 9/1998 | Focke et al. | 206/268 |
| 5,896,984 | A | 4/1999 | Focke et al. | |
| 5,904,244 | A * | 5/1999 | Focke et al. | 206/268 |
| 6,041,997 | A * | 3/2000 | Jensen | 229/114 |
| 6,109,516 | A * | 8/2000 | Laghi et al. | 229/146 |
| 6,719,131 | B1 * | 4/2004 | Focke et al. | 206/268 |
| 7,100,763 | B2 * | 9/2006 | Draghetti | 206/268 |
| 2003/0029746 | A1 * | 2/2003 | Draghetti et al. | 206/268 |
| 2004/0173668 | A1 * | 9/2004 | Conti et al. | 229/146 |
| 2007/0267468 | A1 * | 11/2007 | Burke et al. | 229/146 |

FOREIGN PATENT DOCUMENTS

| | | | |
|---|---|---|---|
| CN | 1520375 | A | 8/2004 |
| DE | 19718821 | A | 11/1998 |
| DE | 19718821 | A1 | 11/1998 |
| DE | 19938167 | A1 | 2/2001 |
| DE | 19938167 | A1 | 2/2001 |
| EP | 0675056 | A | 10/1995 |
| EP | 0675056 | B1 | 10/1997 |
| GB | 1431173 | | 4/1976 |
| GB | 2059387 | A | 4/1981 |
| GB | 2059387 | A | 4/1981 |
| JP | 52-041091 | A | 3/1977 |

OTHER PUBLICATIONS

International Preliminary Report on Patentability corresponding to PCT/EP2009/053189 mailed Jul. 7, 2010.

Chinese Patent Office Communication for corresponding Chinese Application No. 200980113141.1, dated May 3, 2012, referencing CN 86102941 and CN 1520375 (copies with machine translations attached).

Japanese Patent Office Communication for corresponding Japanese Application No. 2011-504400, dated Mar. 5, 2013, referencing JP 52-041091 (copy with machine translation attached).

Philippines Patent Office Communication for corresponding Philippines Application No. 12010502066, dated Jan. 31, 2013, referencing US 2922565 (copy attached).

Russian Patent Office Communication for corresponding Russian Application No. 2010145993, referencing GB 2059387 and US 2922565 (copies attached).

Ukraine Patent Office Communication for corresponding Ukraine Application No. 201013295, dated May 4, 2012, referencing GB 2059387, US 4216898, DE 19718821, DE 19938167, US 5896984, EP 0675056 (copies attached; machine translations attached for non-English references).

Ukraine Patent Office Communication for corresponding Ukraine Application No. 201013295, dated Apr. 5, 2013, referencing CA 654558 (copy attached).

* cited by examiner

PACKAGE FOR SMOKING ARTICLES

CLAIM FOR PRIORITY

This application is a National Stage Entry entitled to and hereby claims priority under 35 U.S.C. §§365 and 371 to corresponding PCT Application No. PCT/EP2009/053189, filed Mar. 18, 2009, which in turn claims priority to British Application Serial No. GB 0806700.1, filed Apr. 14, 2008. The entire contents of the aforementioned applications are herein expressly incorporated by reference.

DESCRIPTION

The present invention relates to a package, and to blanks for making the package. In particular, the invention relates to hinged-lid packages for smoking articles, but is not limited thereto.

As used herein, the term "smoking article" includes smokeable products such as cigarettes, cigars and cigarillos whether based on tobacco, tobacco derivatives, expanded tobacco, reconstituted tobacco or tobacco substitutes and also heat-not-burn products but is not limited thereto. The smoking article may be provided with a filter for the gaseous flow drawn by the smoker.

Hinged-lid packets are well known to those skilled in the art and are in widespread use in the tobacco industry for holding cigarettes in a crush resistant manner. An example of such a hinged-lid packet is shown in GB 1 431 173 and generally holds ten to twenty individual cigarettes in a predetermined arrangement. Hinged lid packets are typically produced from a pair of cardboard blanks.

A first blank forms the outer shell comprising a main body of a front wall, a rear wall, a pair of side-walls extending between the front and rear walls, a base, and a lid hingedly connected to the rear wall, and a second blank forms an insert or inner shell that is generally mounted to the inside of the front and side walls of the outer shell to project above the outer walls and is exposed when the lid is open. The exposed portion of the inner shell projecting above the walls is covered by front and side walls of the lid portion and is used to generate a seal between the main body and the lid portion when the lid is closed. In particular, the inner shell attempts to retain the lid in a closed position by the inner surfaces of the lid front and side walls frictionally engaging with the exposed surface of the inner shell However, a problem with conventional packages is that the inner shell does not sufficiently act upon the lid to retain the lid in a closed position, in particular due to the inner shell being mounted to the inner surface of the outer shell and so the inner shell does not project against the lid. In an attempt to overcome this problem, it is known by those skilled in the art to provide tabs or ears which are formed from the inner shell and project outwardly towards the inner surface of the lid when the lid is closed. Such tabs assist in frictionally holding the lid closed by acting against the inner surface of the lid.

A disadvantage of the above arrangement is that the tabs do not actually 'lock' the lid in a fully closed position and a user is not provided with any tactile indication or feedback that the lid has been fully closed. The lid is also prone to 'yawning' or 'smiling' wherein the lid is disposed in a partially open position.

Additionally, in a conventional package, the tabs are permanently pressed against the inner surface of the lid when the lid is closed which may cause the tabs to deteriorate and become ineffective as they may be bent due to forces and pressure acting on the exterior of the outer shell.

The present invention seeks to provide a package that overcomes or substantially alleviates the problems with conventional hinged-lid packages referred to above.

According to the present invention, there is provided a package for smoking articles comprising a body and a lid hingedly connected to the body to enclose a space defined by the body when the lid is closed, the lid including an end portion and a wall extending from the end portion that overlaps a face of the body when closed, wherein a recess is formed in the wall and a tab extends from said face such that, when the lid is closed, the tab locates in said recess.

Preferably, the tab and wall are configured such that they cooperate when the lid is opened or closed, said tab locating in the recess when the lid is closed.

Advantageously, the wall and the tab are configured such that the wall is resiliently deformed by the tab when the tab and wall cooperate with each other.

In one embodiment, the wall and the tab are configured such that the tab is resiliently deformed by the wall when the tab and wall cooperate with each other.

The wall of the lid may be a side wall that lies in a plane extending perpendicular to an axis about which the lid rotates.

The side wall may comprise outer and inner layers and the recess may be defined by a cut-out formed in the inner layer.

In a preferred embodiment, the cut-out extends along one edge of the wall.

Conveniently, the side wall has a first edge that extends from the end portion, the cut-out being formed along a second edge transverse to the first edge.

Preferably, a front wall extends from the second edge, the front wall being substantially perpendicular to the side wall and the end portion.

Conveniently, the side wall has a free edge, said cut-out being open ended and extending to said free edge.

The cut-out may comprise first and second portions, the second portion comprising a side face configured to guide the tab from said free edge to the first portion of the cut-out and the side face may be arcuate.

Advantageously, the side wall has a free edge, said cut-out extending towards said free edge but terminating short thereof.

In a preferred embodiment, the tab extends from one edge of the face of the body.

Preferably, the tab extends transversely from said face of the body.

Advantageously, the tab comprises a pair of tab portions separated by a cut.

Preferably, the tab portions and the recess are configured such that, when the lid is in the closed position, one tab portion locates in the recess and the other tab portion cooperates with an inner surface of the wall.

The body may comprise an inner shell and an outer shell, the inner shell being received in the outer shell and the tab extending from the inner shell such that, when the lid is closed, the wall overlaps the inner shell.

The inner shell may comprise a front wall and at least one side wall, a portion of the front wall and side wall being cut away such that interference between the inner shell and the lid is reduced when the lid is opened or closed.

The lid preferably comprises a pair of opposing walls extending from opposing edges of the end portion that overlap corresponding opposing faces of the body when closed, wherein each wall has a recess formed therein and a tab extends from each face, such that, when the lid is closed, the tabs locate in said recesses.

According to the present invention, there is also provided a package containing smoking articles.

Preferred embodiments of the present invention will now be described, by way of example only, with reference to the accompanying drawings, in which.

Figure 1:
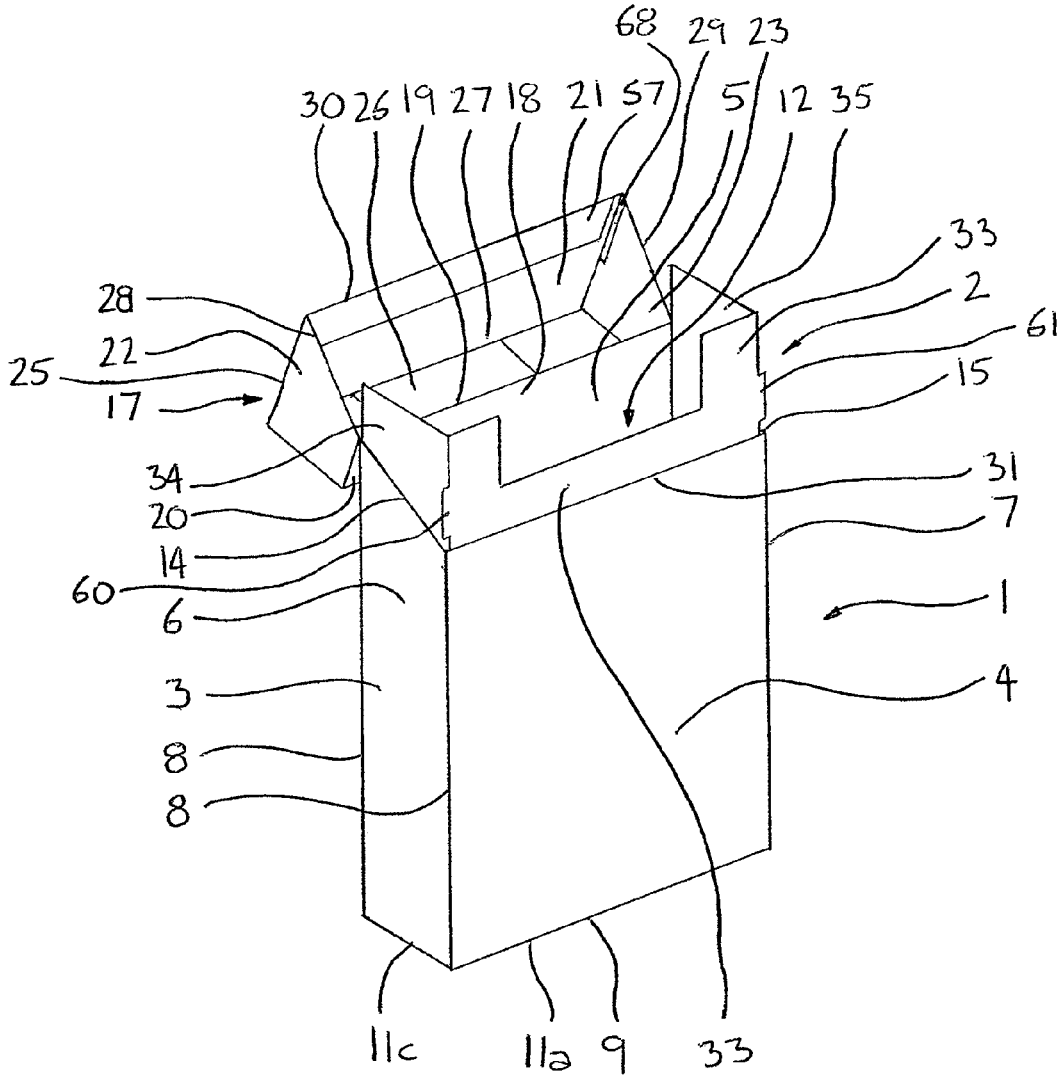
FIG. 1 is a perspective view of a package for smoking articles in accordance with an embodiment of the present invention.
Figure 2:
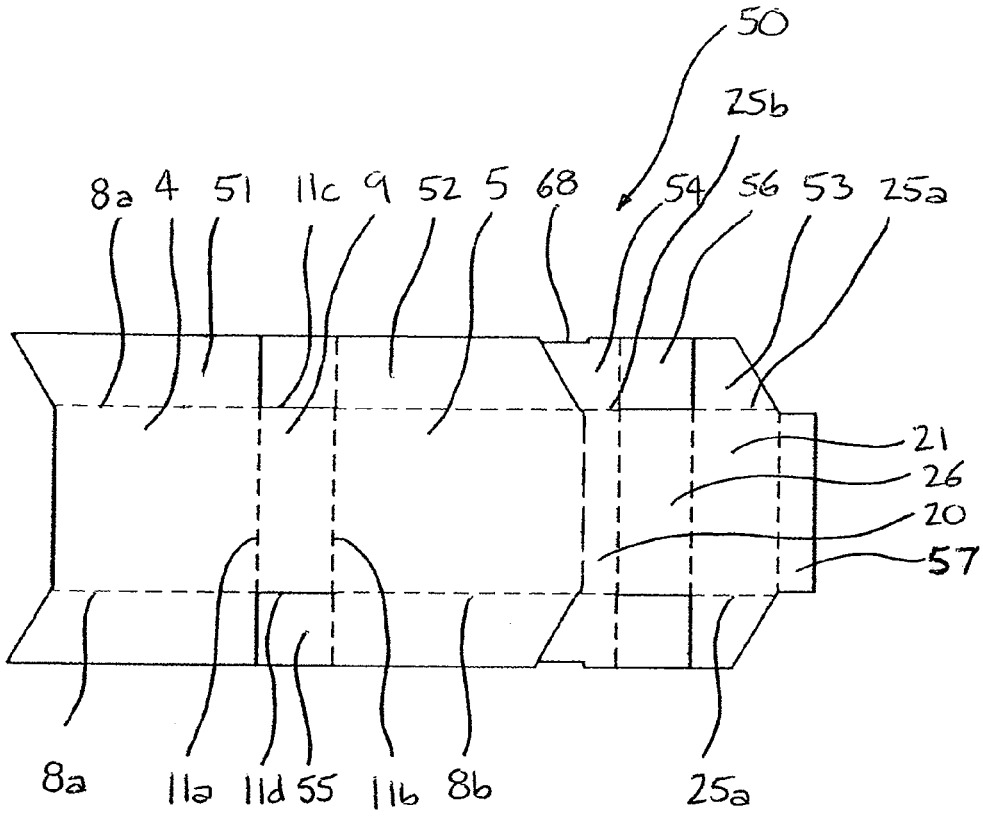
FIG. 2 is a plan view of the blank used to form the outer shell of the package for smoking articles shown in FIG. 1.

Referring to the drawings, there is shown in FIGS. 1 and 2 a package for smoking articles according to an embodiment of the present invention comprising an outer shell 1 and an inner shell 2. In FIG. 2, the dotted lines denote fold lines and the solid lines denote cut-lines as will become apparent in the description below.

The outer shell 1 comprises a main body 3 including a body front wall 4, a body rear wall 5 (refer to FIG. 2) disposed parallel to the body front wall 4, a pair of parallel body side walls 6,7 which extend between the body front and rear walls 4,5, perpendicular thereto, and connect therewith along fold lines 8 and a base 9 which extends across the lower ends 11*a-d* of the body front, rear and side walls 4,5,6,7 respectively to enclose the main body 3 at the lower end thereof such that a smoking article receiving space 12 is defined by the main body 3. Upper ends 14,15 of the body side walls 6,7 are formed at an incline relative to the lower ends 11*c*,11*d* such that the body front wall 4 is shorter than the body rear wall 5. The above arrangement allows easier access to the smoking article receiving space 12 and has additional advantages that will become apparent hereinafter.

The outer and inner shells 1,2 are formed from a stiff, resilient material, for example a cardboard or plastic, such that the hinged lid packet retains its shape and so that the contents disposed in the smoking article receiving space 12 are protected.

The outer shell 1 further comprises a lid 17 which is hingedly connected to an upper end 18 of the body rear wall 5 at a hinge line 19. The lid 17 includes a lid rear wall 20 which is connected to the body rear wall 5 at the hinge line 19, a lid front wall 21 disposed parallel to the lid rear wall 20, a pair of parallel lid side walls 22,23 which extend between the lid rear and front walls 20,21 and connect therewith along fold lines 25 and a top 26 which extends across the upper ends 27 of the lid rear, front, and side walls 20,21,22,23 respectively to enclose the lid 17 at an upper end thereof.

Lower ends 28,29 of the lid side walls 22,23 are formed at an incline relative to the upper ends 27 thereof such that, when the lid 17 is rotated about the hinge line 19 so that the body front wall 4 lies parallel to the lid front wall 21, lower ends 30,28,29 of the lid front wall 21 and lid side walls 22,23 are disposed to lie proximate and parallel to upper ends 31,14,15 of the body front wall 4 and body side walls 6,7 respectively. In the above described position the outer shell 1 is 'closed' and the enclosed smoking article receiving space 12 is defined therein.

Figure 3:
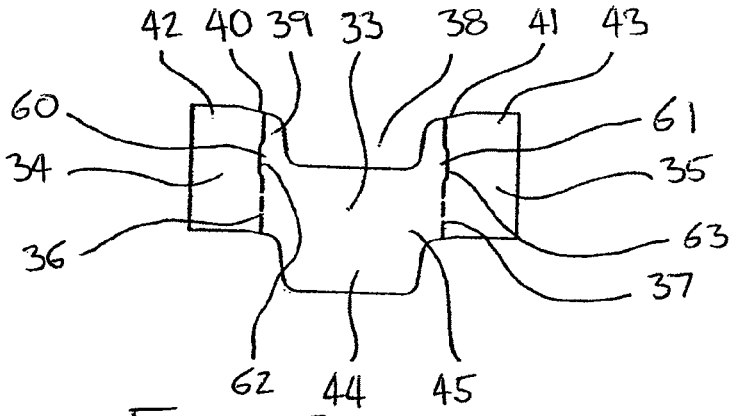
FIG. 3 is a plan view of the blank used to form the inner shell of the package for smoking articles shown in FIG. 1.
Figure 4:
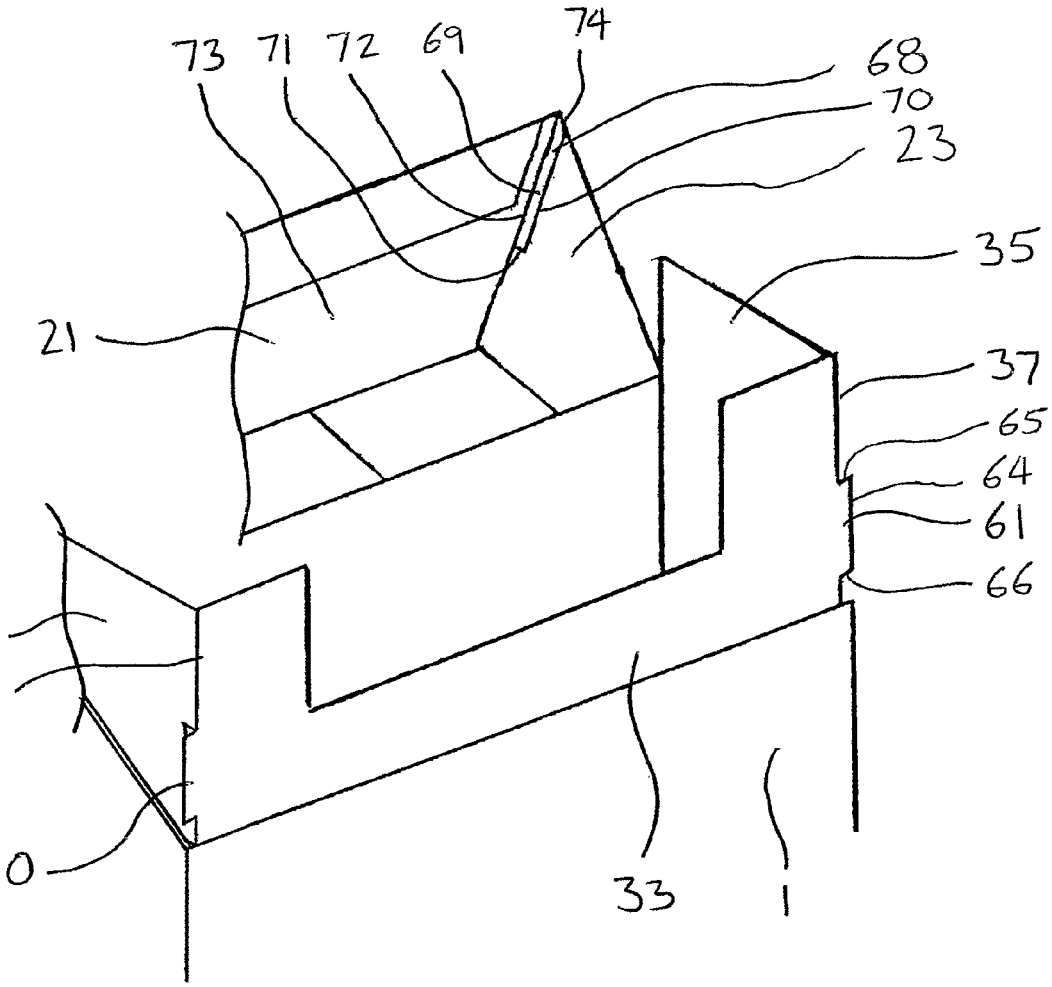
FIG. 4 is a perspective view of a package for smoking articles showing a tab and recess of the package for smoking articles shown in FIG. 1.

Referring to FIGS. 1 and 3, the inner shell 2 comprises an inner shell front wall 33 and a pair of inner shell side walls 34,35. Each inner shell side wall 34,35 extends perpendicularly from the inner shell front wall 33 at fold lines 36,37. A cut-out portion 38 is formed from an upper end 39 of the inner shell front wall 33 and extends therealong and each inner shell side wall has upper ends 42,43. Additionally, a protrusion 44 is formed at a lower end 45 of the inner shell front wall 33.

The inner shell front and side walls 33,34,35 are fixedly mounted to inner faces of the main body front 4 and side walls 6,7 respectively. The upper ends 39,42,43 of the inner shell front and side walls 33,34,35 project above the upper ends 31,14,15 of the body front and side walls 4,6,7 respectively.

In the exemplary embodiment described above, the outer shell 1 is formed from a single blank 50 as shown in FIG. 2. Referring to the outer shell blank 50, the main body side walls 6,7 are formed from first body side flaps 51 extending from the body front wall 4 along fold lines 8*a* and second body side flaps 52 extending from the body rear wall 5 along fold lines 8*b*. When the outer shell 1 is assembled the first body side flaps 51 extending from the body front wall 4 overlap the second body side flaps 52 extending from the body rear wall 5 and are fixedly mounted thereto by means of an adhesive to form the body side walls 6,7.

Similarly, the lid side walls 22,23 are formed from first lid side flaps 53 extending from the lid front wall 21 along fold lines 25*a* and second lid side flaps 54 extending from the lid rear wall 20 along fold lines 25*b*. When the outer shell 1 is assembled the first lid side flaps 53 extending from the lid front wall 21 overlap the second lid side flaps 54 extending from the lid rear wall 20 and are fixedly mounted thereto by means of an adhesive to form the lid side walls 22,23 such that the first lid side flaps 53 form an outer surface of the lid side walls 22,23 and the second lid side flaps 54 form an inner surface of the lid side walls 22,23.

Base flaps 55 extend from a lower end of the second body side flaps 52 and are fixedly mounted to an inner face of the body base 9 to securely form the body base 9 and mount the body base 9 to the body side walls 6,7. Similarly, top flaps 56 extend from the upper end of the second lid side flaps 54 and are fixedly mounted to an inner face of the lid top 26, to securely form the lid top 26 and mount the lid top 26 to the lid side walls 22,23.

A return flap 57 extends along an opposing end of the lid front wall 21 to the lid top 26 and is folded and fixedly mounted to a face of the lid front wall 21 (refer to FIG. 1). The return flap 57 provides additional support for the front wall 21 and strengthens it.

Referring now to FIGS. 1 to 4, the hinged-lid packet comprises a pair of tabs 60,61 extending sideways from the inner shell side walls 34,35. Each tab 60,61 extends perpendicular to the inner shell side walls 34,35 parallel to the inner shell front wall 33 and along the same plane thereof. Each tab 60,61 is formed from the inner shell 2 by means of a cut line 62,63 formed in the inner shell side walls 34,35. Each cut line 62,63 defines the tabs 60,61 which comprise a tab outer edge 64 and a pair of tab side edges 65,66. The pair of tab side edges 65,66 extend from the tab outer edge 64 to the respective fold line 36,37 such that when the inner shell side walls 34,35 are folded with respect to the inner shell front wall 33, the tabs 60,61 extend therefrom. Each tab 60,61 has rounded corners (not shown). The tabs 60,61 are therefore formed from the same material as the inner shell 1 and so are formed from a resilient material, for reasons that will become apparent hereinafter.

A pair of recesses 68 are formed in the opposing inner surfaces of the pair of lid side walls 22,23. Each recess 68 is formed from a cut-out formed in the second lid side flaps 54 such that a portion of the first lid side flap 53 communicates with an inner region of the lid 17. Each recess 68 is formed proximate to an edge of the second lid side flaps 54, such that when the lid 17 is assembled each recess 68 comprises a recess base 69 formed by the first lid side flap 53, first and second recess side faces 70,71 formed by the edges of the cut out formed in the second lid side flaps 54, a third recess side face 72 formed by an inner surface 73 of the lid front wall 21, and wherein each recess 68 extends to the respective lower end 28,29 of the lid side walls 22,23 such that the recess 68 has an open end 74. The lower ends 28,29 of the lid side walls 22,23 each have a free edge, wherein there is no other wall or portion extending from said edge.

Operation of the hinged-lid packet will now be described with reference to FIGS. 1 to 4. When the inner and outer shells 1,2 are assembled to form the hinged lid-packet and define the enclosed smoking article receiving space 12, smoking articles (not shown) are disposed in the packet. The lid 17 is then hingedly rotatable to open and close the outer shell 1 such that the smoking articles (not shown) are accessible to a user.

When the lid 17 is rotated from its 'open' position, wherein the enclosed smoking article receiving space is accessible and the lid rear wall 20 is rotated to face the body rear wall 5, to its 'closed' position wherein the body front wall 4 lies parallel to the lid front wall 21 and lower ends 30,28,29 of the lid front wall 21 and lid side walls 22,23 are disposed to lie proximate and parallel to upper ends 31,14,15 of the body front wall 4 and body side walls 6,7 respectively, the tabs 60,61 contact and communicate with the inner surface of the first lid side flaps 53, which form the lid side walls 22,23, such that each respective tab 60,61 and lid side walls 22,23 are urged against each other due to the inner shell side walls 34,35 being fixedly mounted to the outer shell side walls 6,7 and due to the resilience of the packet. Therefore, the lid side walls 22,23 are resiliently deformed by the tabs 60,61 and the tabs 60,61 provide resistance against the lid 17 and restrict the movement thereof. Alternatively, the tabs 60,61 are resiliently deformed when each tab 60,61 co-operates with its respective lid side wall 22,23.

If a user continues to rotate the lid 17 into its 'closed' position, the recesses 68 are moved relative to the tabs 60,61 such that the tabs 60,61 locate therein. As the tabs 60,61 and lid side walls 22,23 co-operate and are urged thereagainst each other, then the tabs 60,61 spring into the respectives recesses 68. This causes an audible sound to be produced as the outer edge 64 of each tab 60,61 is released by the first recess side face 70 and springs into the respective recess 68. As each tab 60,61 is then located in a respectively recess then the lid 17 is securely held in a 'closed' position by each tab 60,61 locating against the respective first recess side face 70. The audible sound produced is in the form of a 'click' as each tab 60,61 springs into the respective recess 68 and impacts upon a surface therein. The audible sound indicates to the user that the lid 17 is securely held in a 'closed' position.

In a situation where a user requires access to the enclosed smoking article space 12 then the operation is reversed. The lid is rotated into an open position and each tab 60,61 contacts the respective first recess side face 70. As an additional force is applied each tab 60,61 or side wall 22,23 is resiliently deformed such that each tab 60,61 is released from the respective recess 68 and the lid is rotatable into its 'open' position.

Figure 5:
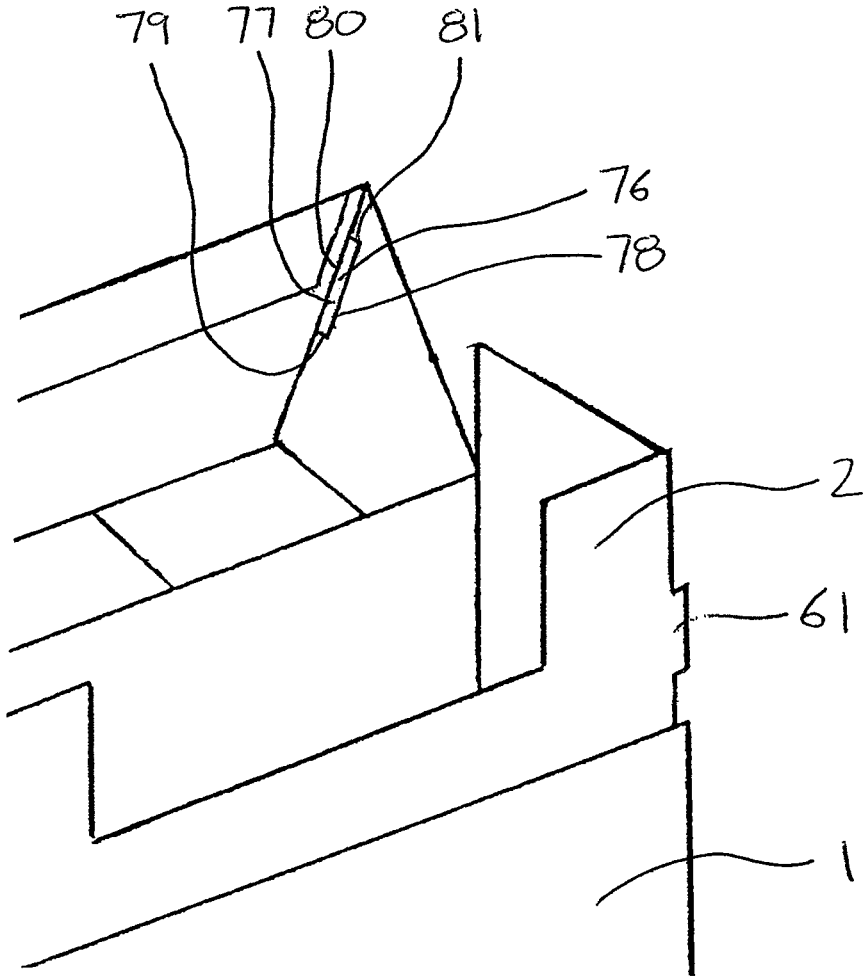
FIG. 5 is a perspective view of a package for smoking articles showing a tab and recess in accordance with another embodiment of the present invention.
Figure 6:
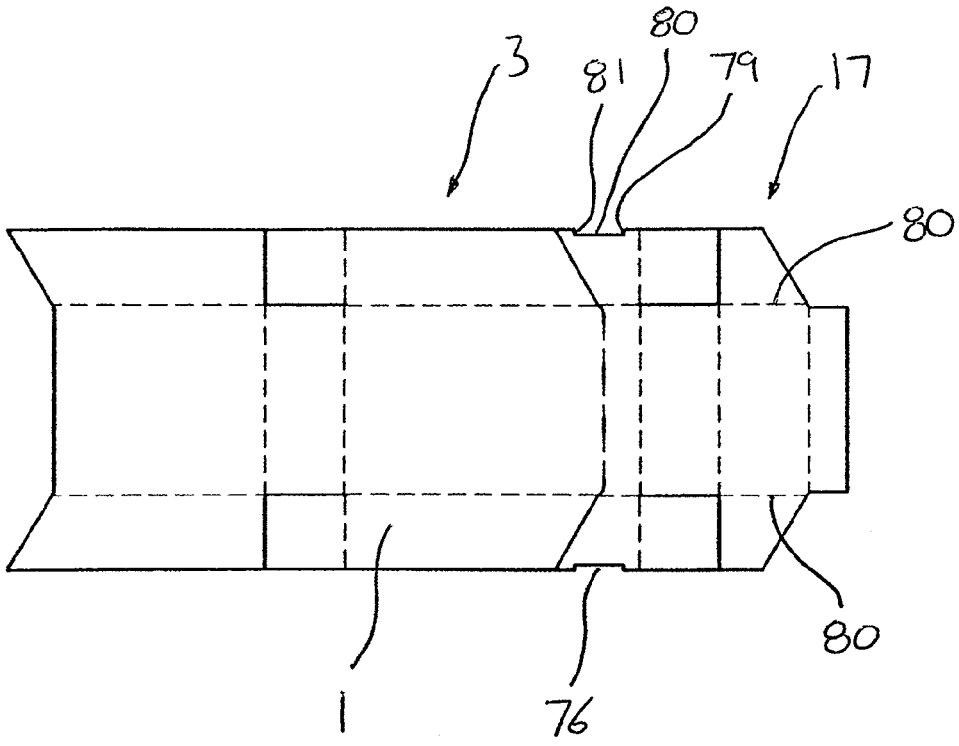
FIG. 6 is a plan view of the blank used to form the outer shell of the package for smoking articles shown in FIG. 5.
Figure 7:
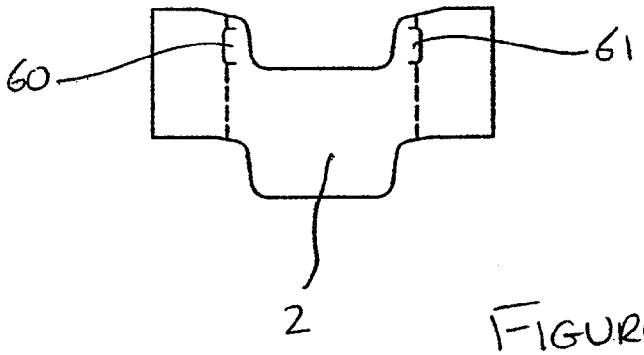
FIG. 7 is a plan view of the blank used to form the inner shell of the package for smoking articles shown in FIG. 5.

Another exemplary embodiment will now be described with reference to FIGS. 5 to 7. It is noted that the outer and inner shells 1,2 are generally the same as those described in the above exemplary embodiment and so further description of these will be omitted, however, in this embodiment the recesses formed in the lid 17 are different.

In this embodiment, a recess 76 is formed in each opposing inner surface of the pair of lid side walls 22,23. Each recess 76 is formed from a cut-out formed in the second lid side flaps 54 such that a portion of the first lid side flap 53 communicates with an inner region of the lid 17. Each recess 76 is formed proximate to an edge of the second lid side flaps 54, such that when the lid 17 is assembled the recess comprises a recess base 77 formed by the first lid side flap 53, first and second recess side faces 78,79 formed by the edges of the cut out formed in the second lid side flaps 54, a third recess side face 80 formed by an inner surface 73 of the lid front wall 21, and additionally a fourth recess side face 81 is formed proximate to the respective lower end 28,29 of the lid side walls 22,23, such that each recess 76 is fully enclosed and does not extend to the free edge.

An advantage of the recess 76 discussed above is that the recess 76 is fully enclosed such that it cannot be seen from the respective lower end 28,29 of the lid side walls 22,23.

During operation of the hinged-lid packet according to the above embodiment, when the lid 17 is in its 'closed' position, the pair of tab side edges 65,66 locate proximate to the second and fourth recess side faces 79,81.

Figure 8:
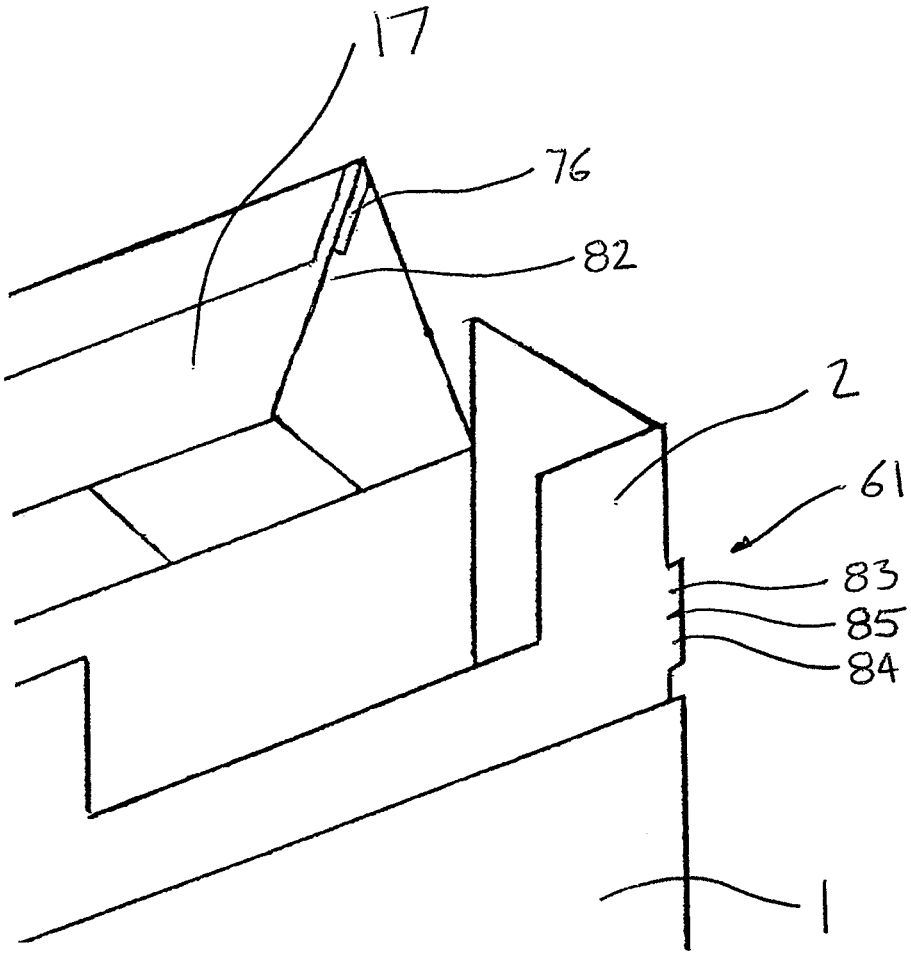
FIG. 8 is a perspective view of a package for smoking articles showing a tab and recess in accordance with another embodiment of the present invention.
Figure 9:
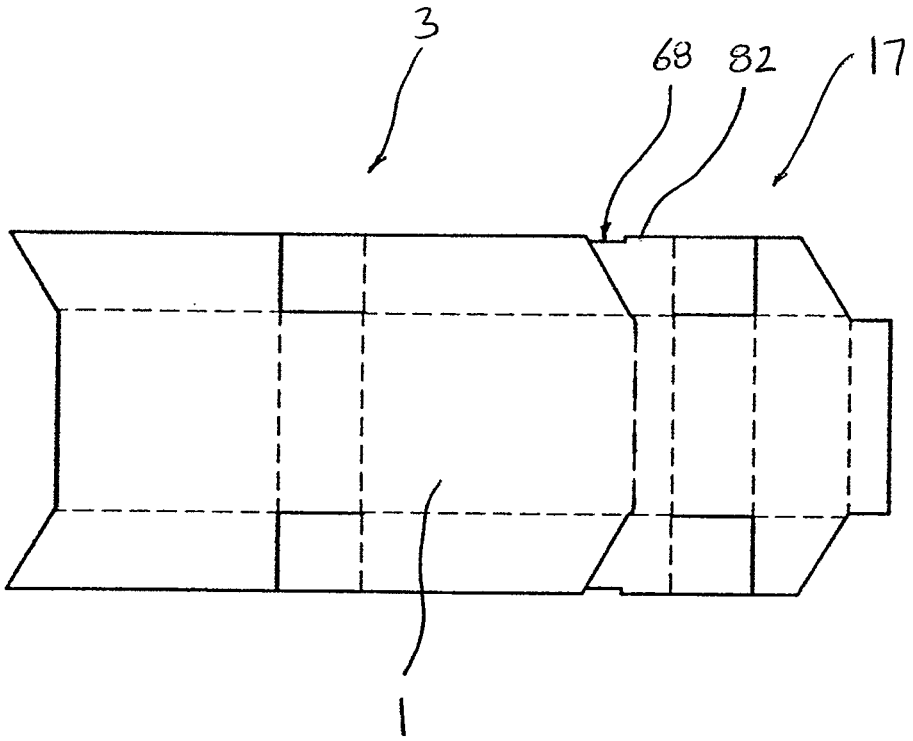
FIG. 9 is a plan view of the blank used to form the outer shell of the package for smoking articles shown in FIG. 8.
Figure 10:
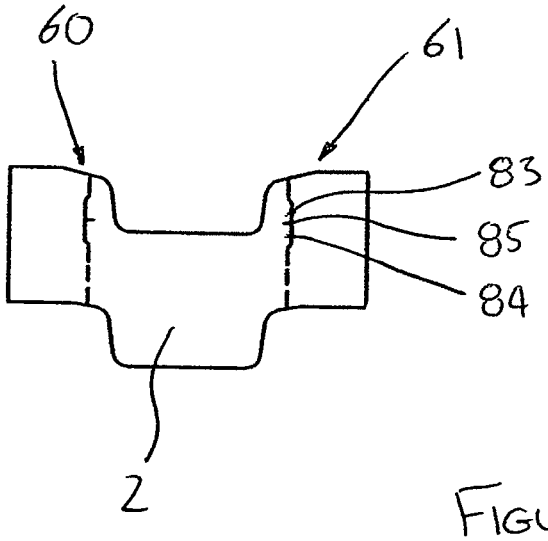
FIG. 10 is a plan view of the blank used to form the inner shell of the package for smoking articles shown in FIG. 8.

Another exemplary embodiment will now be described with reference to FIGS. 8 to 10. It is noted that the outer and inner shells 1,2 are generally the same as those described in the above exemplary embodiments and so further description of these will be omitted herein, however, in this embodiment the tabs formed in the inner shell 2 are different.

In this exemplary embodiment, the tabs 60,61 are formed substantially as before, however, each tab 60,61 is divided into first and second tab portions 83,84 formed by a cut line 85. The cut line extends from the fold line 37, although the tabs 60,61 are not folded, to the tab outer edge 64. Although the tab portions 83,84 are shown in this embodiment to be equally sized, it will be understood that the tab portions 83,84 may have different dimensions dependent on the positioning of the cut line 85.

Further, in this embodiment the length of the recesses 68 are determined such that a first tab portion 83 does not locate in the respective recess 68 when the lid is rotated into its 'closed' position, but so that the second tab portion 84 does extend therein. Subsequently, when the lid is in its 'closed' position, each first tab portion 83 locates against a section 82 of the respective lid side wall 22,23 and urges there against or the respective lid side wall 22,23 is urged against the first tab portion 83.

One advantage of dividing a tab 60,61 into separate first and second tab portions 83,84 is that it allows one tab portion 84 to locate in the respective recess 68 whilst the other tab portion 83 provides resistance against the lid 17 and ensures a close fit therewith. Further, it reduces the number of cuts required to form two separate tabs (not shown) on each inner shell side wall 34,35 to produce the same effect.

Although in the above exemplary embodiment the tabs 60,61 are shown split, such that the second tab portion 84 locates in the recess 17 and the first tab portion 83 locates against a section 82 of the respective lid side wall 22,23 when the lid 17 is in a 'closed' position, it will be understood by a person skilled in the art that the invention is not limited thereto, and that a pair of tabs may be formed to extend from each side of the inner shell front wall on each side distal to each other, wherein one tab locates in a slot and the other tab locates against the inner side wall face when the lid 17 is closed.

Figure 11:
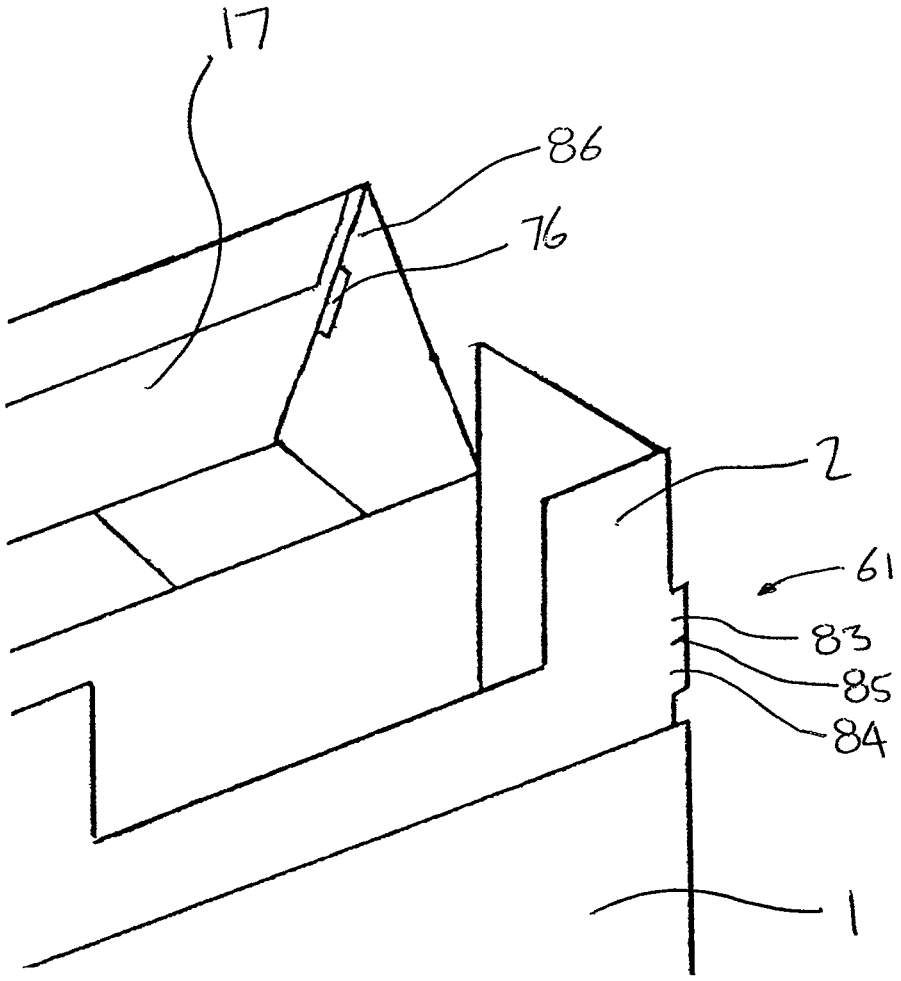
FIG. 11 is a perspective view of a package for smoking articles showing a tab and recess in accordance with another embodiment of the present invention.
Figure 12:
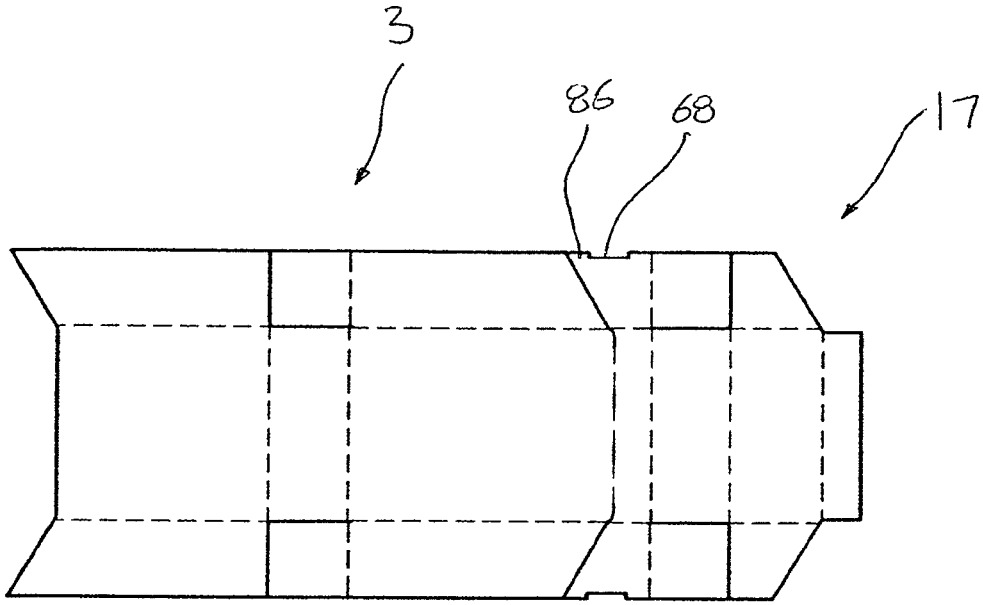
FIG. 12 is a plan view of the blank used to form the outer shell of the package for smoking articles shown in FIG. 11.
Figure 13:
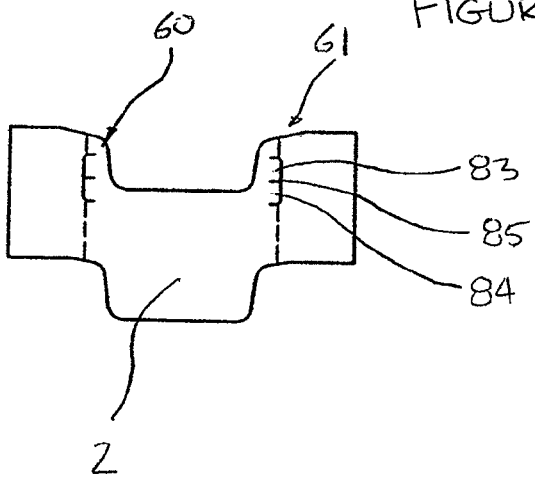
FIG. 13 is a plan view of the blank used to form the inner shell of the package for smoking articles shown in FIG. 11.
Figure 14:
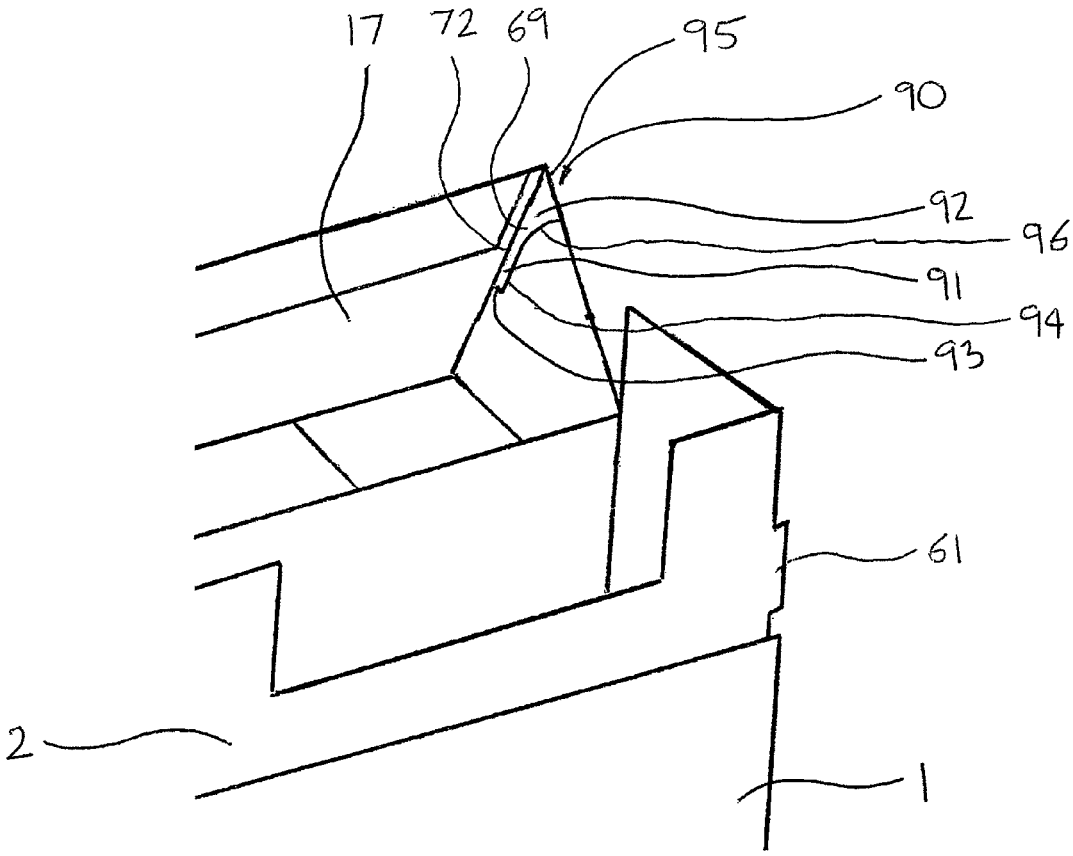
FIG. 14 is a perspective view of a package for smoking articles showing a tab and recess in accordance with another embodiment of the present invention.
Figure 15:
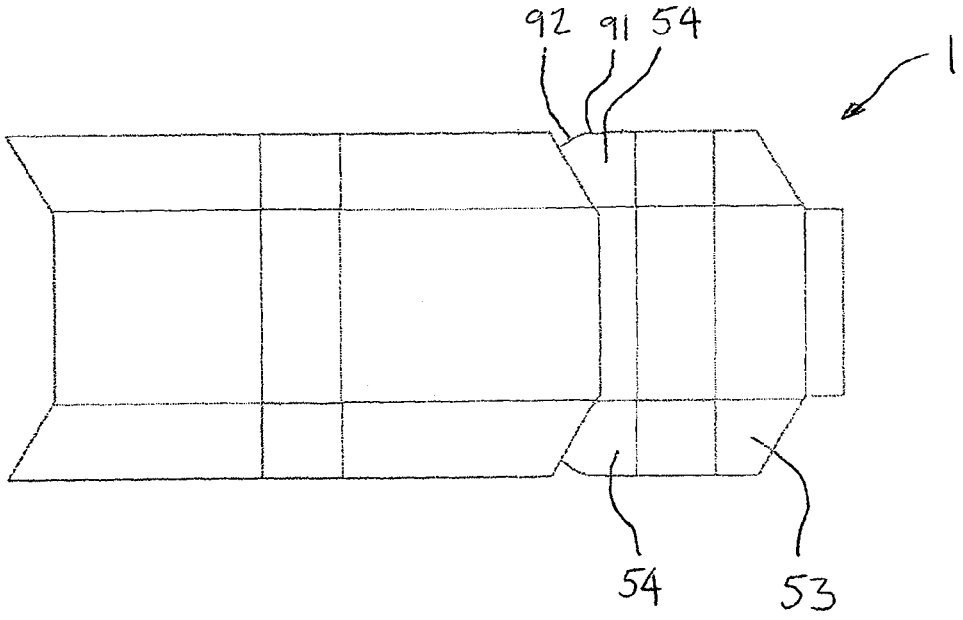
FIG. 15 is a plan view of the blank used to form the outer shell of the package for smoking articles shown in FIG. 14.
Figure 16:
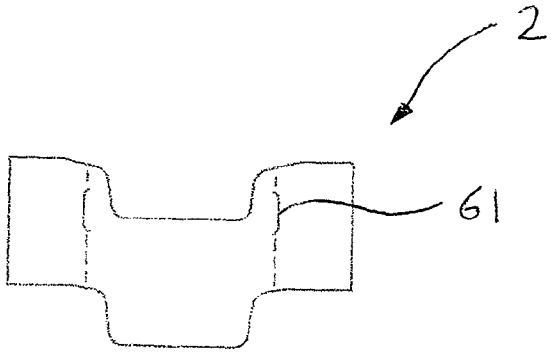
FIG. 16 is a plan view of the blank used to form the inner shell of the package for smoking articles shown in FIG. 14.
Figure 17:
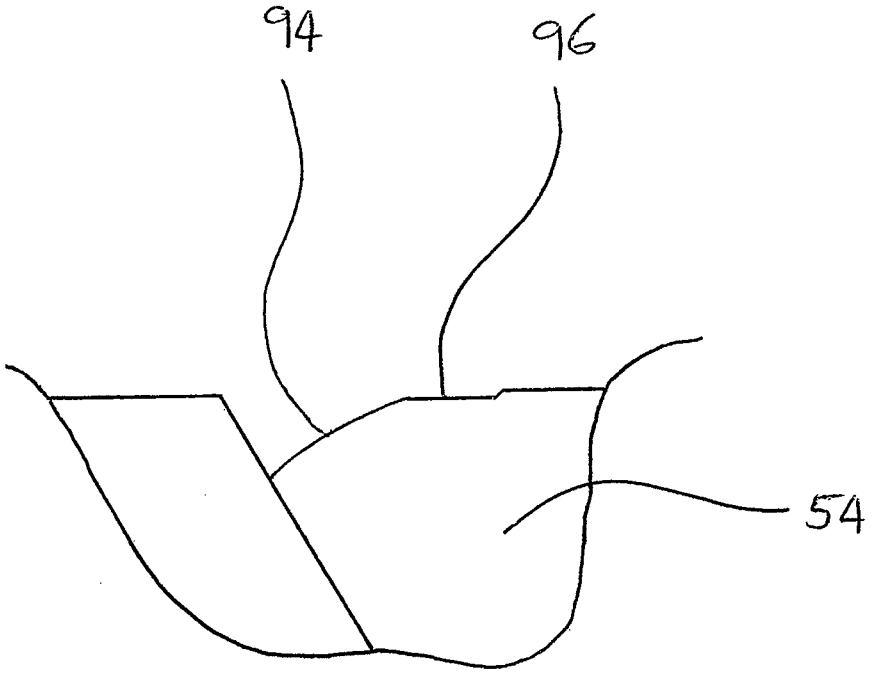
FIG. 17 is an enlarged view of a portion of the blank shown in FIG. 15.

Another exemplary embodiment will now be described with reference to FIGS. 11 to 13. It is noted that the outer and inner shells 1,2 are generally the same as those described in the above exemplary embodiments and so further description of these will be omitted herein.

In this exemplary embodiment, the tabs 60,61 are formed substantially as described in the embodiment described above with each tab 60,61 divided into first and second tab portions 83,84 formed by a cut line 85.

Further, in this embodiment, the pair of recesses 76 are formed in the opposing inner surfaces of the pair of lid side walls 22,23. However, each recess 76 is formed proximate to an edge of the second lid side flaps 54, such that when the lid 17 is assembled the recess comprises a recess base 77 formed by the first lid side flap 53, first and second recess side faces 78,79 formed by the edges of the cut out formed in the second lid side flaps 54, a third recess side face 80 formed by an inner surface 73 of the lid front wall 21, and additionally a fourth recess side face 81 is formed proximate to the respective lower end 28,29 of the lid side walls 22,23 such that each recess 76 is fully enclosed and a section 86 of lid side wall is formed between the fourth recess side face 81 and the lower end 28,29 of the respective lid side wall 22,23.

Therefore, when the lid 17 is rotated into its 'closed' position, each first tab portion 83 extends into its respective recess 76, however, the second tab portion 84 does not locate in the respective recess 68 because it locates against a section 86 of the respective lid side wall 22,23 and urges there against or the respective lid side wall 22,23 is urged against the second tab portion 84.

Another exemplary embodiment will now be described with reference to FIGS. 14 to 17. It is noted that the outer and inner shells 1,2 are generally the same as those described in the exemplary embodiment shown in FIGS. 1 to 4 and so further description of these will be omitted herein, however, in this embodiment the recesses formed in the opposing inner surfaces of the pair of lid side walls 22,23 are different.

In this exemplary embodiment, the recesses 90 are formed substantially as before, however, in this embodiment each recess 90 is divided into inner and outer recess portions 91,92. Each recess 90 is formed from a cut-out formed on the second lid side flaps 54 such that a portion of the first lid side flap 53 communicates with an inner region of the lid 17 to form a recess base 69. Each recess 90 is formed proximate to an edge of the second lid side flaps 54, such that when the lid 17 is assembled each recess comprises a third recess side face 72 formed by an inner surface 73 of the lid front wall 21.

However, in this embodiment the inner recess portion 91 comprises a first side face 93 and a second side face 94 formed by the edges of the cut-out. The second side face 94 of the inner recess portion 91 extends parallel to the third recess side face 72. The inner recess portion 91 communicates with the outer recess portion 92 at an opposing end to the first side face 93 of the inner recess portion 91. The outer recess portion 92 extends from the inner recess portion 91 to the respective lower end 28,29 of the lid side walls 22,23 such that the outer recess portion 92 has an open end 95.

The outer recess portion 92 comprises an arcuate side face 96 extending from the second side face 94 of the inner recess portion 91 and opposing the third recess side face 72. The arcuate side face 96 of the outer recess portion 92 arcs away from the third recess side face 72 such that the width of the outer recess portion 92 proximate to the open end 95 is greater than the width of the outer recess portion 92 proximate to the inner recess portion 91. The arc of the arcuate side face 96 corresponds to the arcuate movement of the tab 61 relative to the respective lid side wall 22,23 as the lid 17 is rotated between its 'open' and 'closed' position. As the lid 17 is rotated into its 'closed' position, the tab is guided into the inner recess portion 91 by the outer recess portion 92. It will be understood that the inner and outer recess portions 91,92 may have different dimensions dependent on the positioning of the tab 61.

Further, in this embodiment the length of the recesses 68 are determined such that the tab 61 locates in the inner recess portion 91 when the lid is rotated into its 'closed' position. Subsequently, when the lid is in its 'closed' position, each tab 61 locates against the recess base 69 and urges thereagainst.

One advantage of the above embodiment is that it allows the outer recess portion 92 to act as a guide for a corresponding tab 61 such that the tab 61 properly locates in the respective inner recess portion 91, when the lid 17 is closed. Further, it reduces any noise produced when the tab 61 locates in the inner recess portion 91 as the lid 17 is closed.

Although in the above exemplary embodiment the outer recess portion 92 is shown to have an arcuate recess side face 96, it will be understood by a person skilled in the art that the invention is not limited thereto, and that the arcuate recess side face 96 may be formed to have a straight edge which extends at an angle from the first side face of the first recess portion 91 to the open end 95, such that the width of the outer recess portion 91 at the open end 95 is greater than the width of the outer recess portion 92 proximate to the inner recess portion 91.

Figure 18:
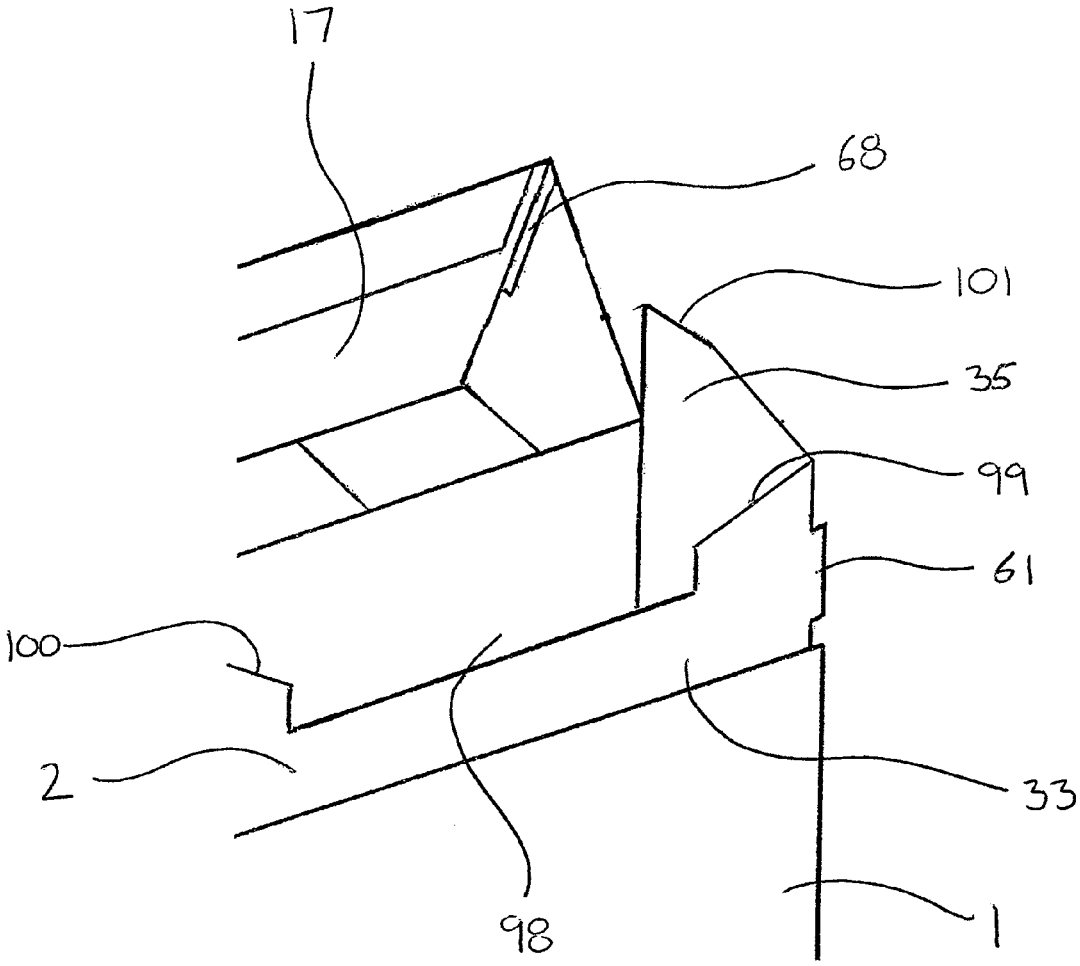
FIG. 18 is a perspective view of a package for smoking articles showing a tab and recess in accordance with another embodiment of the present invention.
Figure 19:
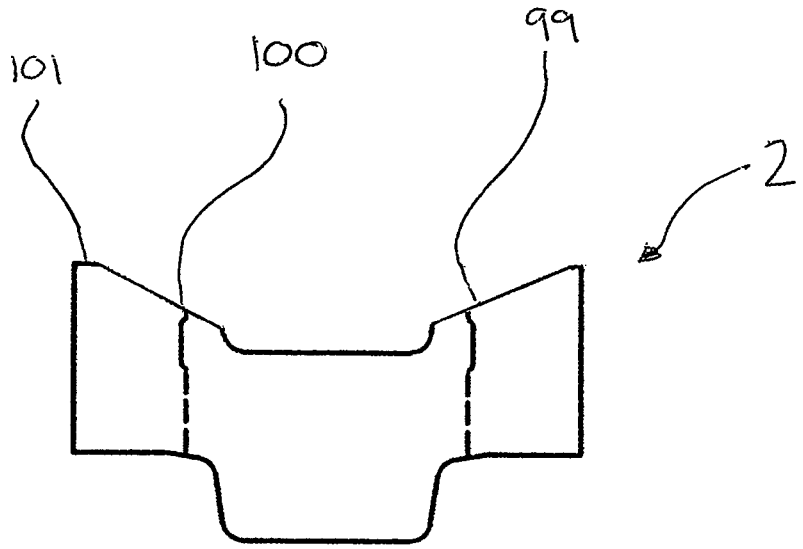
FIG. 19 is a plan view of the blank used to form the inner shell of the package for smoking articles shown in FIG. 18.

Another exemplary embodiment will now be described with reference to FIGS. 18 and 19. It is noted that the outer and inner shells 1,2 are generally the same as those described in the above exemplary embodiments and so further description of these will be omitted herein, however, in this embodiment the upper ends of the inner shell front and side walls 33,34,35 are different.

In this exemplary embodiment, the inner shell 2 comprises a cut-out portion 98 formed from the inner shell front wall 33 and extends therealong, and slice portions 99,100 of the upper ends of the inner shell front wall 33 extending from the cut-out portion 98 and extending across upper ends 101 of each inner shell side wall 34,35. Each slice portion 99,100 reduces the height of the inner shell front and side walls 33,34,35 proximate to the front wall 33 such that the upper ends of the inner shell front and side walls 33,34,35 do not impact the lid 17 as the lid 17 is rotated between its 'open' and 'closed' positions. Therefore, the interference between the lid 17 and the inner shell 2 is reduced or eliminated when the lid 17 is rotated between its 'open' and 'closed' positions.

It will be appreciated by a person skilled in the art that the above embodiment, wherein the inner shell 2 features slice portions 99,100 which reduce or eliminate the interference between the inner shell 2 and the lid 17, may be used in conjunction with any of the other embodiments of the invention described herein. Although in each of the above described exemplary embodiments a pair of tabs are utilised, one extending on each side of the inner shell front wall, the invention is not limited thereto and a tab may be formed on only one side of the inner shell front wall. Alternatively, a plurality of tabs may be formed to extend from each side of the inner shell front wall to locate in a plurality of slots formed in the inner face of the lid side wall.

Further, although tabs are shown in the exemplary embodiments to extend sideways from the edge of the front wall of the inner shell, the invention is not limited thereto and the tabs may project perpendicularly from the face of the sidewalls of the inner shell distal from the fold lines 36,37. Additionally, in the above exemplary embodiments the hinged-lid packet is formed from an inner and outer shell wherein the tabs are formed on the inner shell, in an alternative embodiment the tabs may be formed on an outer shell.

Although embodiments of the invention have been shown and described, it will be appreciated by those skilled in the art that variations may be made to the above exemplary embodiment that lie within the scope of the invention, as defined in the following claims.

The invention claimed is:

1. A package for smoking articles, comprising:

a body; and a lid hingedly connected to the body forming an enclosed space defined by the body when the lid is closed, the lid including an end portion and a side wall extending from the end portion that overlaps a side face of the body when closed, wherein a recess is formed in the side wall and a tab extends from said side face, such that the tab contacts the side wall in which the recess is formed when the lid is pivoted towards its closed position, the tab locating in the recess in the side wall when the closed position is reached and wherein the recess comprises an inner recess portion and an outer recess portion, the inner recess portion having a first side face perpendicular to a second side face, and the outer recess portion having an arcuate side edge configured to guide the tab into the inner recess portion towards the first side face when the lid is pivoted towards its closed position.

2. The package according to claim 1, wherein the side wall and the tab are configured such that the side wall is resiliently deformed by the tab when the tab and the side wall cooperate with each other.

3. The package according to claim 1, wherein the side wall and the tab are configured such that the tab is resiliently deformed by the side wall when the tab and the side wall cooperate with each other.

4. The package according to claim 1, wherein the side wall lies in a plane extending perpendicular to an axis about which the lid rotates.

5. The package according to claim 4, wherein the side wall comprises outer and inner layers.

6. The package according to claim 5, wherein the recess is defined by a cut-out formed in the inner layer.

7. The package according to claim 6, wherein the cut-out extends along one edge of the side wall.

8. The package according to claim 7, wherein the side wall has a first edge that extends from the end portion, the cut-out being formed along a second edge transverse to the first edge.

9. The package according to claim 8, wherein a front wall extends from the second edge, the front wall being substantially perpendicular to the side wall and the end portion.

10. The package according to claim 6, wherein the side wall has a free edge, said cut-out being open ended and extending to said free edge.

11. The package according to claim 10, wherein the cut-out comprises first and second portions, the second portion comprising a side face configured to guide the tab from said free edge to the first portion of the cut-out.

12. The package according to claim 11, wherein the side face is arcuate.

13. The package according to claim 6, wherein the side wall has a free edge, said cut-out extending towards said free edge but terminating short thereof.

14. The package according to claim 1, wherein the tab extends from one edge of the face of the body.

15. The package according to claim 1, wherein the tab extends transversely from said face of the body.

16. The package according to claim 1, wherein the tab comprises a pair of tab portions separated by a cut.

17. The package according to claim 16, wherein the tab portions and the recess are configured such that, when the lid is in the closed position, one tab portion locates in the recess and the other tab portion cooperates with an inner surface of the side wall.

18. The package according to claim 1, wherein the body comprises an inner shell and an outer shell, the inner shell being received in the outer shell and the tab extending from the inner shell such that, when the lid is closed, the side wall overlaps the inner shell.

19. The package according to claim 18, wherein the inner shell comprises a front wall and at least one side wall, a portion of the front wall and the at least one side wall being cut away such that interference between the inner shell and the lid is reduced when the lid is opened or closed.

20. The package according to claim 1, wherein the lid comprises a pair of opposing walls extending from opposing edges of the end portion that overlap corresponding opposing faces of the body when closed, wherein each wall has a recess formed therein and a tab extends from each face, such that, when the lid is closed, the tabs locate in said recesses.

21. A package for smoking articles, comprising a body and a lid hingedly connected to the body forming an enclosed space, the enclosed space containing smoking articles and defined by the body when the lid is closed, the lid including an end portion and a side wall extending form the end portion that overlaps a side face of the body when closed, a recess formed in the side wall, said recess comprising an inner recess portion having a first side face perpendicular to a second side face and an outer recess portion, and a tab extending from said side face, such that the tab contacts the side wall in which the recess is formed when the lid is pivoted towards a closed position, the tab locating in the inner recess portion in the side wall when the closed position is reached, the outer recess portion comprising an arcuate side edge configured to guide the tab into the inner recess portion towards the first side face when the lid is pivoted towards its closed position.

* * * * *